US007637197B2

(12) United States Patent
Herrmann et al.

(10) Patent No.: US 7,637,197 B2
(45) Date of Patent: Dec. 29, 2009

(54) WEAPON WITH BREACH MECHANISM

(75) Inventors: Ralf-Joachim Herrmann, Senzig (DE); Heiner Schmees, Celle (DE); Hans Hülsewis, Duisburg (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 10 days.

(21) Appl. No.: 11/975,509

(22) Filed: Oct. 19, 2007

(65) Prior Publication Data

US 2008/0276796 A1 Nov. 13, 2008

Related U.S. Application Data

(60) Provisional application No. 60/959,948, filed on Jul. 18, 2007.

(30) Foreign Application Priority Data

Oct. 20, 2006 (DE) ..... 10 2006 050 408

(51) Int. Cl.
*F41A 3/00* (2006.01)

(52) U.S. Cl. ..... 89/17; 42/75.02

(58) Field of Classification Search ..... 89/17
See application file for complete search history.

(56) References Cited

U.S. PATENT DOCUMENTS

| | | | | |
|---|---|---|---|---|
| 14,491 A | | 3/1856 | Burnside | |
| 2,998,755 A | | 9/1961 | Thierry | |
| 4,240,324 A | | 12/1980 | Smith et al. | |
| 4,660,458 A | | 4/1987 | von Laar et al. | |
| 4,709,616 A | * | 12/1987 | Bartolles | 89/26 |
| 6,571,676 B1 | * | 6/2003 | Folsom et al. | 89/17 |
| 7,121,035 B2 | * | 10/2006 | Greer | 42/77 |
| 7,178,443 B2 | | 2/2007 | Isgen et al. | |

FOREIGN PATENT DOCUMENTS

| | | |
|---|---|---|
| DE | 34 24 215 | 1/1986 |
| DE | 40 09 050 | 9/1991 |
| DE | 195 01 003 | 7/1996 |
| DE | 196 24 400 | 1/1997 |
| DE | 197 29 293 | 1/1999 |
| DE | 198 23 785 | 12/1999 |
| DE | 199 28 277 | 1/2001 |
| DE | 199 32 562 | 2/2001 |
| DE | 199 41 066 | 3/2001 |
| DE | 103 17 177 | 11/2004 |
| GB | 229 6962 | 1/1995 |
| JP | 2000 171196 | 6/2000 |
| WO | WO 02/095319 | 11/2002 |

* cited by examiner

*Primary Examiner*—Troy Chambers
*Assistant Examiner*—Samir Abdosh
(74) *Attorney, Agent, or Firm*—Lucas & Mercanti, LLP; Klaus P. Stoffel

(57) ABSTRACT

It is proposed that a loading chamber of a weapon with a breech mechanism no longer be part of a cannon tube but rather that it form, together with a breechblock, a unit, which additionally contains a device for firing ammunition and which can move relative to the bore portion of the cannon tube. This design solution can be used in all weapons with various and different breech mechanisms.

7 Claims, 4 Drawing Sheets

WEAPON WITH BREACH MECHANISM

This application claims priority from Provisional Application No. 60/959,948, filed Jul. 18, 2007, the entire contents of which are incorporated herein by reference

BACKGROUND OF THE INVENTION

The space requirement behind a breech-loading, for example, large-caliber cannon, also known as a breechloader, is determined, on the one hand by the recoil distance and, on the other hand, by the length of the projectile and propellant charge. The length of the projectile and propellant charge is the decisive factor, for example, in the case of fin-stabilized guided projectiles or in the case of fire out-of-battery systems. In the case of fin-stabilized guided projectiles, advantageous projectile lengths are those which are well above a necessary recoil distance. In the case of fire out-of-battery recoil systems, the ammunition is loaded with the weapon in the recoiled position.

If the projectile and propellant charge are significantly longer than the recoil distance, then the weapon generally moves into an index position for loading the ammunition, or the space that is necessary for loading the ammunition is made available over the entire aiming range in the weapons carrier. The space for loading the ammunition results in a high weight and volume of the weapons carrier, while moving into an index position reduces the rate of fire.

A loading system for conveying ammunition from a magazine chamber located behind the weapon is described in DE 199 32 562 B4. This loading system comprises a bridge that bridges the space between the magazine chamber and the weapon in its loaded position. The loading bridge itself consists of two complementary halves. The first half is pivoted on the nonrecoiling part of the weapon in such a way that it rotates about an axis of rotation that is perpendicular to the bore axis of the weapon, and the second half is pivoted on the wall of the magazine chamber in such a way that it likewise rotates about an axis of rotation perpendicular to the bore axis of the weapon. The goal here is to bridge the space needed or left free for the recoil of the weapon by a pivoting loading bridge.

Various breech mechanisms are disclosed by DE 103 17 177 A1, DE 197 29 293 B4, DE 198 23 785 C2, DE 199 41 066 B4, and DE 199 28 277 C2.

DE 103 17 177 A1, for example, discloses a sliding block breech mechanism, which, to allow it to be guided without the use of an external drive, is guided along a curved track of a guiding device that is fixed relative to the cradle and maintains itself in the opened position.

The transverse action breech mechanism described in DE 198 23 785 C2 is distinguished by the fact that when the opener lever is swiveled from its initial position to its final position, the sliding breechblock is displaced from its closed position to its opened position.

Other well-known breech mechanisms are cylinder breech mechanisms, roller breech mechanisms, trapdoor breech mechanisms, etc., as well as screw-type breech mechanisms.

SUMMARY OF THE INVENTION

The object of the invention is to simplify the loading of a breech-loaded weapon.

The invention is thus based on the idea that projectiles and propellant charges that are significantly longer than the recoil distance are loaded over the entire aiming range; the space requirement behind the weapon is determined only by the recoil distance. To this end, a loading chamber is no longer part of a cannon tube but rather, together with a breechblock, forms a unit that moves relative to the bore portion of the cannon tube.

Although it is well-known from small-caliber and medium-caliber weapons that the shell chamber, which is comparable to the loading chamber, can be separated from the cannon tube by integrating it in a drum that is supported in a way that allows it to rotate about the cannon tube or gun barrel (DE 195 01 003 C2, DE 196 24 400 C2), a moving breech mechanism is dispensed with in these systems, and only a stationary breechblock is used. Sealing problems and erosion that arise in these systems are solved or prevented, for example, by sealing rings or small gaps between the cannon tube and the shell chamber. In cases in which, on the other hand, the breech mechanism with ammunition is conveyed to the cannon tube, the loading chamber or shell chamber and cannon tube also form a unit here.

DE 92 08 018 U1 discloses that in order to reduce the production of heat in a shell chamber, at least two shell chambers are alternately brought behind the barrel, so that the chamber which is hot is taken out of action and the other is used for firing. In this operation, the chambers can be swiveled, rotated, or moved linearly. The breech mechanism for its part is not part of these chambers but rather is moved back and forth.

In accordance with the invention, to open and close the breech mechanism, the loading chamber and breechblock are moved as a single part relative to the bore portion of the cannon tube.

Depending on the design, the following relative movements are possible:

- displacement transverse to the longitudinal axis of the bore;
- rotation about an axis transverse to the longitudinal axis of the bore; and
- rotation about an axis parallel to the longitudinal axis of the bore.

For adequate sealing and power transmission (locking) between the tube and the loading chamber, the following solutions can be provided, depending on the type of relative movement (see above):

- analogous to the sliding block breech mechanism with steel obturator ring (angle section). The loading chamber is integrated in the sliding breechblock (displacement transverse to the longitudinal axis of the tube); an additional variant is created by moving the sliding breechblock in a circular path (rotation about an axis parallel to the longitudinal axis of the tube);
- analogous to the screw-type breech mechanism with highly elastic obturator. The loading chamber is integrated in the breechblock (rotation about an axis transverse to the longitudinal axis of the bore).

The basic prerequisite for implementation of the invention is that either the shell is exactly as long as the space defined as the loading chamber or separation of the projectile and propellant charge is possible, such that the projectile is placed in the cannon tube at the same time that the propellant charge is being pushed into the loading chamber in the direction opposite the firing direction. The first possibility presents itself especially in the case of small-caliber and medium-caliber shells (ammunition), since ammunition of this type is often of the same size as the loading chamber and in some cases no longer has any protruding projectile head or the like. The second variant is customary especially in the case of large-caliber projectiles.

The advantages of this solution include the fact that the maximum projectile length can now amount to the sum of the recoil distance, the length of the loading chamber, and the thickness of the breechblock, while the space requirement behind the weapon is determined solely by the weapon's recoil.

The projectile and propellant charge can be loaded simultaneously, especially in the case of large-caliber ammunition. The placement of the projectile is more simplified inasmuch as the projectile does not have to cross the loading chamber during placement. The projectile path during placement is shorter than in a conventional breechloader by the length of the loading chamber. In this regard, the invention allows a smaller swivel radius of the loading arm, which rotates about the trunnion axis, than is necessary in conventional breechloaders.

The invention is explained in greater detail below with reference to the specific embodiment illustrated in the drawings.

DETAILED DESCRIPTION OF THE DRAWINGS

Figure 1A:
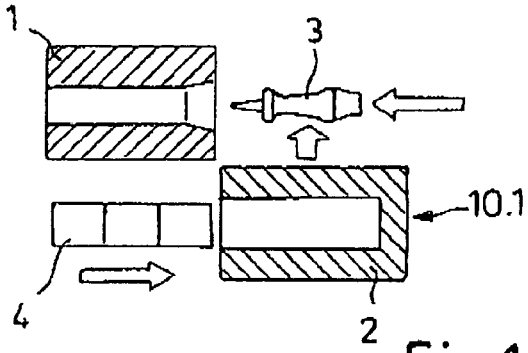
FIGS. 1*a-c* show possible ways of integrating of a loading chamber in different types of breech mechanisms.

The drawings show a cannon tube 1 for receiving a projectile 3 as well as a loading chamber 2, which is separated from the cannon tube 1, for receiving a propellant charge 4 (in this case for (large-caliber) ammunition 20), which is separated from the projectile 3. The loading chamber 2 is integrated in a unit 10 that can move relative to the bore portion of the cannon tube 1. Movement of the unit 10 relative to the bore portion can be realized in a variety of ways.

Figure 1B:
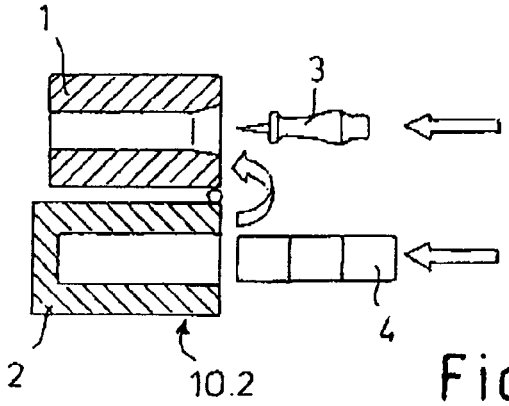
Figure 1B:
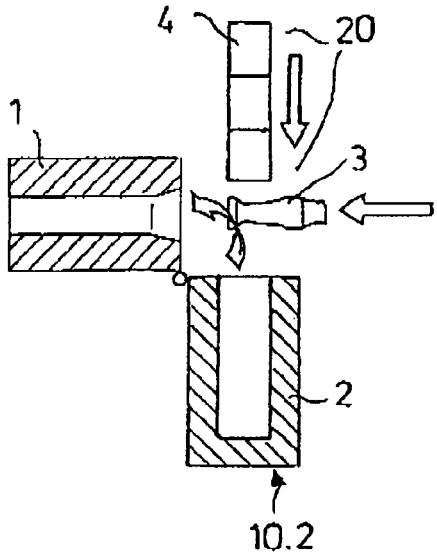
Figure 1C:
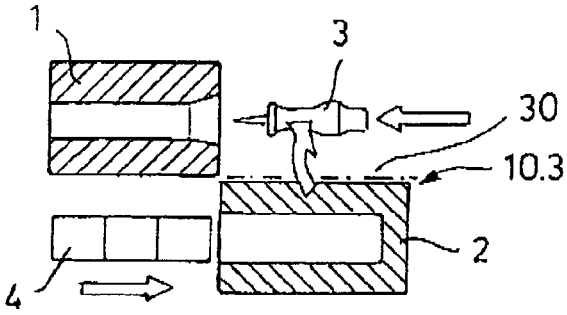

Depending on the type of relative movement of the unit 10 that is provided, the loading chamber 2 can be integrated in a type of sliding breechblock 10.1, as illustrated in FIG. 1*a*. According to FIG. 1*b*, the loading chamber 2 can be integrated in a type of breechblock 10.2. The loading chamber 2 in FIG. 1*c* is also integrated in a type of sliding breechblock 10.3, but in this case the sliding breechblock 10.3 moves on a circular path around an axis 30.

Figure 2:
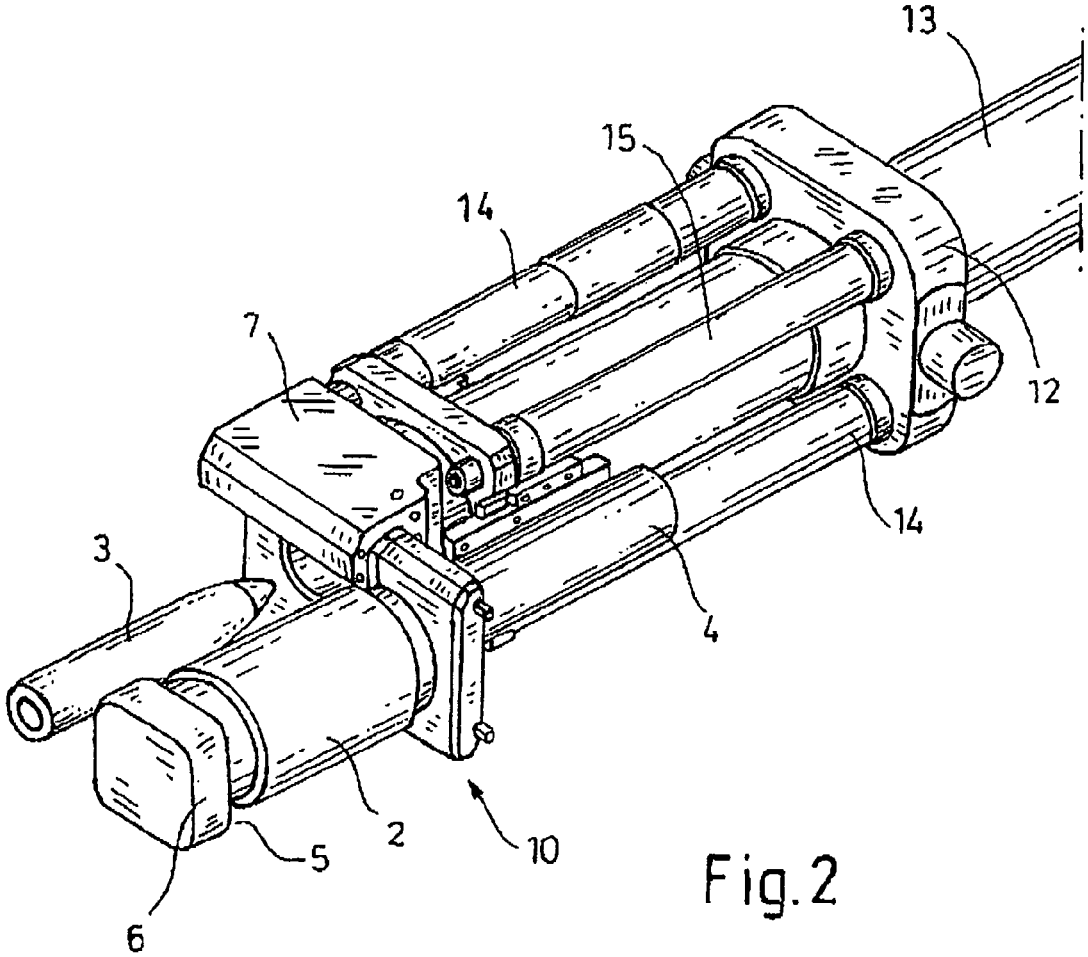
FIG. 2 is a perspective view of a large-caliber cannon with loading chamber and breech mechanism separated from the cannon tube.

In this regard, the projectile 3 is placed in the cannon tube 1, and at the same time the propellant charge 4 is pushed into the loading chamber 2 in the opposite direction from the firing direction, and the unit 10 is brought into position in front of the cannon tube 1 if separated ammunition is involved. On the other hand, if the ammunition has the same length as the loading chamber 2 integrated in the unit 10, this ammunition is brought into the loading chamber 2 in such a way that, in the closed position, it points in the direction of the cannon tube 1 and touches the tube. Whereas FIGS. 1*a* to 1*c* illustrate the general principle, FIG. 2 shows a concrete application in a large-caliber cannon, where the only parts illustrated are those which are necessary for gaining a better understanding of the device.

Figure 3:
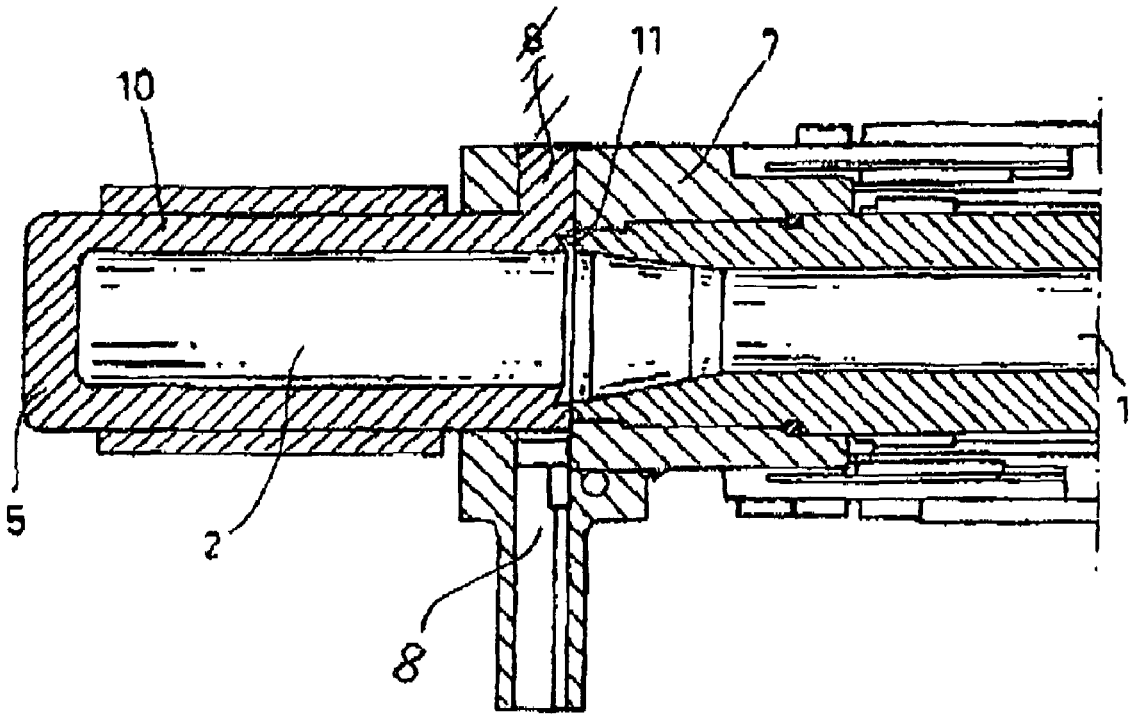
FIG. 3 is a sectional view of the closed breech mechanism.
Figure 4:
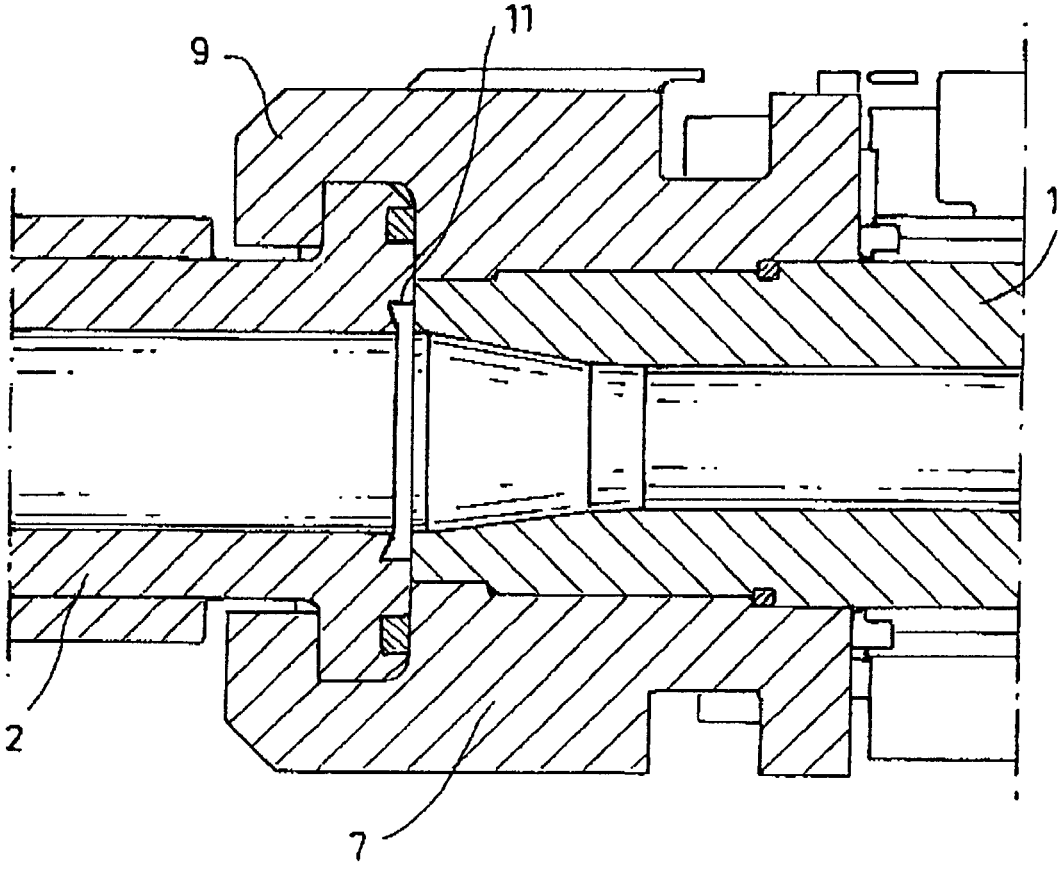
FIG. 4 is another view.

The loading chamber 2 and the breechblock 5, together with a device 6 for igniting the propellant charge (e.g., primer magazine) or the like, i.e., a device necessary for firing the ammunition, form the unit 10 (breech mechanism), which in this embodiment can be moved transversely to the longitudinal axis of the bore. The cannon tube 1 (or bore portion) and the unit 10 are joined by the part 7, which has the same function as the breech ring of a conventional large-caliber cannon with, for example, a sliding block breech mechanism. In this regard, unit 10 is guided in grooves 8 (FIG. 3) like the key of a keyed joint. Power transmission in the longitudinal axis of the bore between the unit 10 and the part 7 is accomplished via cheeks 9 (FIG. 4). This power is transmitted by positive-locking means, for example, by screw thread, from the part 7 to the bore portion of the cannon tube 1. An obturator ring 11 is mounted in the unit 10 (FIG. 3). It provides a seal between the loading chamber 2 and the cannon tube 1. Alternatively, the obturator ring 11 can be integrated in the bore portion of the cannon tube 1. The recoil impulse is transmitted, for example, by hydraulic brakes 14 and counterrecoil mechanisms 15 from part 7 to a cradle roller 12. The cradle roller 12 is rigidly connected with a cradle tube 13. The bore portion of the cannon tube 1 is supported in the cradle tube 13 in such a way that it can be displaced in the direction of the longitudinal axis of the bore.

As noted earlier, in the opened state, the projectile 3 is pushed into the bore portion of the cannon tube 1 in the firing direction and rammed in there. At the same time, the propellant charge 4 is pushed into the loading chamber in the direction opposite the firing direction. The unit 10 is then moved in the grooves 8 until the bore portion and the loading chamber 2 are in line. The obturator ring 11 in this case has the L-shaped profile customary in sliding block breech mechanisms and caseless propellant charges. The angle between the legs of the L-shaped profile is slightly more than a right angle. As is customary in sliding block breech mechanisms, the grooves 8 are inclined by about 1° relative to the sealing surface between the bore portion and the loading chamber 2. In this way, the obturator ring 11 is elastically pretensioned when the bore portion and the loading chamber 2 are in line. As a result of the pretension, a seal is produced even at the beginning of the shot development at low pressures.

As has already been noted, the invention is not limited to large-caliber weapons but also encompasses small-caliber and medium-caliber weapons. The exemplary embodiment described here also does not limit the invention to the use of a sliding block breech mechanism, but rather the idea can be used with all types of breech mechanisms with their relative movements.

The invention claimed is:

1. A weapon, comprising:

a breech mechanism for firing ammunition, where the ammunition is loaded at the breech of the weapon;

a cannon tube;

a breechblock;

a device for firing the ammunition;

a loading chamber, wherein the loading chamber is integrated in a unit, the unit being supported so as to be movable relative to a bore portion of the cannon tube and a longitudinal axis of the bore of the tube, the loading chamber, together with the breechblock and the device for firing the ammunition, forming the breech mechanism of the weapon, whereby a maximum projectile length is a sum of recoil distance, length of the loading chamber and thickness of the breechblock, and wherein a space requirement behind the weapon is determined solely by the recoil of the weapon; and hydraulic brakes and counter-recoil mechanisms arranged so as to transmit a recoil impulse from a part connecting the cannon tube to the unit to a cradle roller that is fixed to a cradle tube.

2. The weapon in accordance with claim 1, wherein the ammunition comprises a projectile and a propellant charge that can be loaded separately from each other.

3. The weapon in accordance with claim 2, wherein, when separated ammunition is used, the projectile is pushed into the bore of the cannon tube in a firing direction and rammed in, and the propellant charge is pushed into the loading chamber in an opened state in a direction opposite the firing direction.

4. The weapon in accordance with claim 2, wherein, when ammunition that is of equal length with the loading chamber is present, the ammunition is pushed into the loading chamber in an opened state.

5. The weapon in accordance with claim 1, wherein, depending on a type of relative movement provided for the unit, the loading chamber is integratable in a sliding breech-block, with or without guidance along a circular path.

6. The weapon in accordance with claim 1, and further comprising an obturator ring mounted in the unit or in the bore portion of the cannon tube for sealing between the loading chamber and the cannon tube.

7. The weapon in accordance with claim 1, wherein the unit is capable of one of the following relative movements:

- displacement transverse to the longitudinal axis of the bore;
- rotation about an axis transverse to the longitudinal axis of the bore;
- rotation about an axis parallel to the longitudinal axis of the bore.

* * * * *